United States Patent [19]

Gerhartz et al.

[11] Patent Number: 4,731,217

[45] Date of Patent: Mar. 15, 1988

[54] METHOD FOR MELT SPINNING THERMOPLASTIC FILAMENT YARN

[75] Inventors: Siegmar Gerhartz, Remscheid; Rolf Kalthoff, Wermelskirchen; Siegfried Putsch, Wuppertal, all of Fed. Rep. of Germany

[73] Assignee: Barmag AG, Remscheid, Fed. Rep. of Germany

[21] Appl. No.: 764,840

[22] Filed: Aug. 9, 1985

[30] Foreign Application Priority Data

Aug. 9, 1984 [DE] Fed. Rep. of Germany ..... 3429308
Aug. 18, 1984 [DE] Fed. Rep. of Germany ..... 3430481
Oct. 27, 1984 [DE] Fed. Rep. of Germany ..... 3439447

[51] Int. Cl.[4] ..... D01D 5/08; B65H 54/38

[52] U.S. Cl. ..... 264/555; 264/129; 264/130; 264/211.12; 264/211.17; 242/18.1; 242/43.1

[58] Field of Search ..... 242/18.1, 43.1, 43 R, 242/159, 174; 264/176 F, 103, 211.17, 555, 211.12, 129, 130

[56] References Cited

U.S. PATENT DOCUMENTS 3,299,485 1/1967 Hills et al. ..... 242/159
3,638,872 2/1972 Jennings ..... 242/18.1
3,727,855 4/1973 Richter ..... 242/18.1
3,973,387 8/1976 Familant ..... 242/159
4,049,211 9/1977 Spescha ..... 242/45
4,093,147 6/1978 Bromley et al. ..... 242/159
4,296,889 10/1981 Martens ..... 242/18.1
4,325,517 4/1982 Schippers et al. ..... 242/43 R
4,377,263 3/1983 Guelpa ..... 242/18.1
4,498,637 2/1985 Yamamoto et al. ..... 242/18.1
4,504,021 3/1985 Schippers et al. ..... 242/174

FOREIGN PATENT DOCUMENTS 055849 12/1981 European Pat. Off. .
7565628 6/1975 Japan .

*Primary Examiner*—Jan H. Silbaugh
*Assistant Examiner*—Hubert C. Lorin
*Attorney, Agent, or Firm*—Bell, Seltzer, Park & Gibson

[57] ABSTRACT

A method for melt spinning thermoplastic filament yarn is disclosed, wherein a plurality of filaments are withdrawn from a spinneret, and combined to form an advancing yarn. The advancing yarn is traversed onto a rotating bobbin to form a wound package, and the traversing speed is periodically rapidly changed so as to avoid the formation of undesirable patterns or ribbons. In addition, the advancing yarn is heated so as to lower its modulus of elasticity, so that the yarn tension and yarn denier remain within an acceptable range of variation during each change of the traversing speed.

8 Claims, 2 Drawing Figures

METHOD FOR MELT SPINNING THERMOPLASTIC FILAMENT YARN

Figure 1:
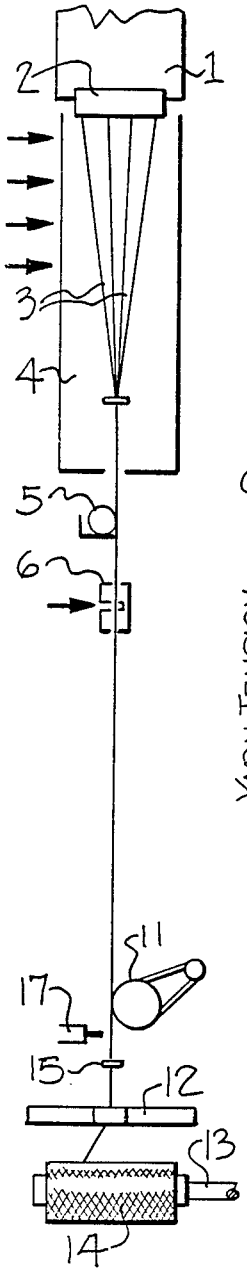

The present invention relates to a method and apparatus for melt spinning thermoplastic filament yarn, and to the subsequent winding of the resulting yarn.

Thermoplastic yarn, for example polyethylene terephthalate, polyamide 6 or 6.6, and polypropylene, are presently withdrawn from spinnerets and wound at speeds of more than 3000 m/minute. As a result of combining the spinning with a yarn winding operation, the winding speed must be maintained substantially uniform, since changes of the winding speed affect the yarn tension and the yarn denier, particularly when the yarn is spun without an interposed feed roll. In addition, there is a problem of the formation of undesirable patterns or ribbons, which must be handled by the yarn takeup system. Such ribbons develop in the portions of the winding cycle in which the winding ratio is an integer, with the winding ratio being defined as the ratio of the spindle speed to the traversing speed, which in turn is expressed as the double stroke rate, i.e., the number of forward and return movements of the yarn traversing device per unit of time. The winding ratios at which ribbons develop, referred to as critical winding ratios, include not only integers, but ratios having an integral, small denominator, such as two, three, or four. Further, the ribbon problem is particularly pronounced in the case of large packages, having for example 500 mm diameter, in which case very serious ribbons may be expected. Another problem involved in the winding technology is the fact that the packages must have good unwinding properties, and it should be possible to unwind the yarns from the packages at high speed, without having a yarn break and without the occurrence of damaging variations of the yarn tension.

A solution to the ribbon formation problem has been suggested in the Japanese publication No. 65 628, which provides for the stepwise changing of the winding ratio during a winding cycle to a respectively smaller value. In so doing, the traversing speed continually decreases during one phase of the winding cycle in such a way that it is proportional to the winding speed, and then is again suddenly increased back to the initial value. The traversing speed then again decreases in another winding phase having a reduced winding ratio, again to be proportional to the spindle speed, and is then again suddenly increased to the initial value. This process is repeated, with the increase in speed occuring at a predetermined point and with sufficient frequency so that yarn tension does not exceed certain predetermined limits.

In the case of winding man made fibers, and in particular man made fibers having a fine denier, into packages of large diameter, there is the risk in the above process that the traversing speed is changed so frequently to avoid high yarn tensions, that the changed traversing speed corresponds to a critical winding ratio, which results in the risk of ribbons. As a result, a compromise must be made between the maximum tolerable yarn tension and pattern formation, and it is necessary under certain circumstances to accept a certain pattern formation so as to avoid unduly high yarn tensions.

It is accordingly an object of the present invention to provide a method and apparatus for melt spinning thermoplastic filament yarn which avoids the formation of undesirable patterns or ribbons in the wound package, while also avoiding undue variations in the yarn tension and yarn denier.

These and other objects and advantages of the present invention are achieved in the embodiment illustrated herein by the provision of a method and apparatus which includes withdrawing a plurality of filaments from a spinneret, and while combining the filaments to form an advancing yarn. The advancing yarn is then positively fed and traversed onto a rotating bobbin to form a wound package, with the traversing speed being varied during each of a series of sequential steps of the winding operation by decreasing in each of the steps the traversing speed proportionally to the decreasing rotational speed of the package and then rapidly increasing the traversing speed to its initial value, so as to avoid the formation of undesirable patterns or ribbons. In addition, the positively fed and advancing yarn is heated so as to lower its modulus of elasticity and so that the yarn tension and the yarn denier remain within an acceptable predetermined range of variation during each change of the traverse speed.

In a preferred embodiment, the heating of the advancing yarn is accomplished by contacting the yarn with a feed roll, and wherein the feed roll is heated to at least about 80° C. Also, the step of heating the advancing yarn is preferably sufficient such that the variation of the yarn tension resulting from each change in the traversing speed does not vary by more than about + or −0.04 cN/dtex from a mean value, and preferably by not more than + or −0.02 cN/dtex, from its mean value. Thus in accordance with the preferred embodiment, the yarn tension does not increase by more than about 0.02 cN/dtex from its mean value during each increase of the traversing speed. It is also preferred that the tension of the yarn immediately prior to being wound onto the package does not exceed about 0.8 cN/dtex, and preferably does not exceed about 0.4 cN/dtex, even during the sudden increase of the traversing speed. Also, in one embodiment, the step of heating the advancing yarn occurs only shortly prior to selected changes of the traversing speed, such as those changes wherein the higher traverse speed is more than 4% greater than the lower traversing speed.

As noted above, a preferred embodiment of the invention includes a heated feed roll against which the yarn is guided before it is wound onto the package. For this purpose, the feed roll is driven at a desired delivery speed at which the yarn is to be withdrawn from the spinneret. However, as a result of the fact that the roll is heated, the modulus of elasticity of the yarn, which reflects the ratio between the yarn tension and elongation, is sufficiently lowered so that the speed changes resulting from the change of the traversing speed and the elongation of the yarn resulting therefrom, lead to only harmless changes in yarn tension. In this regard, the question of the yarn tension becoming harmful is determined by a number of parameters, including the composition of the yarn and the specifics of the winding process. Particularly important for the winding process is the fact that the yarn should be wound on the package below any unduly high and at a uniform tension, over the entire package length. Any sudden changes in the yarn tension should be avoided. In this regard, it has been found that when a yarn is wound at a winding ratio which is uniform over a certain period of time, and where the traversing speed is suddenly changed periodically, the yarn tension increases very suddenly when the traversing speed is increased. The rapid changes of the yarn tension are all the greater the further the yarn tension has dropped during the winding operation at a uniform winding ratio. However, the heating of the feed roll as provided by the present invention, permits the yarn tension to be substantially reduced and made uniform to such an extent that even large and sudden changes of the traversing speed affect the yarn tension very little, and that significant jumps are entirely avoided. As a result, it has become possible to adapt the time intervals with a uniform winding ratio exclusively to the technical winding conditions, and to change the traversing speed only when a pattern free winding ratio is assured with the increase of the traversing speed.

The method and apparatus of the present invention also permits the avoidance of changes of the yarn denier, since the yarn denier is dependent on the withdrawal speed of the feed roll. While the heating of the yarn on the feed roll reduces the flow limit, i.e., the yarn tension at which an irreversible plastic elongation occurs which is beyond the elastic reversible elongation, the extent of the plastic elongation remains limited so that the plastic elongation does not lead to textile technologically significant denier loss.

The temperature of the feed roll preferably ranges from 80° C. to 140° C. In a range between these temperatures, very effective results have been achieved, depending on the yarn denier, polymer, and withdrawal speed. However, it is possible that lower temperatures, from 50° to 80° C., may also lead to an improved uniformity of the yarn tension, while at temperatures higher than 140° C., no significant improvements with regard to a reduction and uniformity of the yarn tension may be expected, although other favorable effects may be achieved in comparison with temperatures in the range up to about 140° C.

In accordance with the present invention, it is also possible to adapt the heating, both in time and with regard to temperature, to the traversing motion. Thus for example, the heating may occur directly prior to the change of the traversing speed to its higher value, and then discontinued following the change. Accordingly, the temperature of the heating system, and specifically the feed roll, should reach its maximum value directly prior to the traversing speed being increased, and it subsequently decreases. In another embodiment, the method may be so carried out that heating occurs only prior to such changes during which the higher traversing speed is more than about 4% greater than the lower traversing speed. Also, it is possible to regulate the heating temperature as a function of the amount of change in the traversing speed.

The heating of the yarn in accordance with the present invention is particularly useful in reducing the yarn tension in the winding zone in installations where the yarn is positively fed, e.g. by means of a godet feed roll, to the traversing and winding device. In installations where the yarn is spun and wound without an intermediate feed roll, the problem of undue yarn tension is not usually significant.

Figure 2:
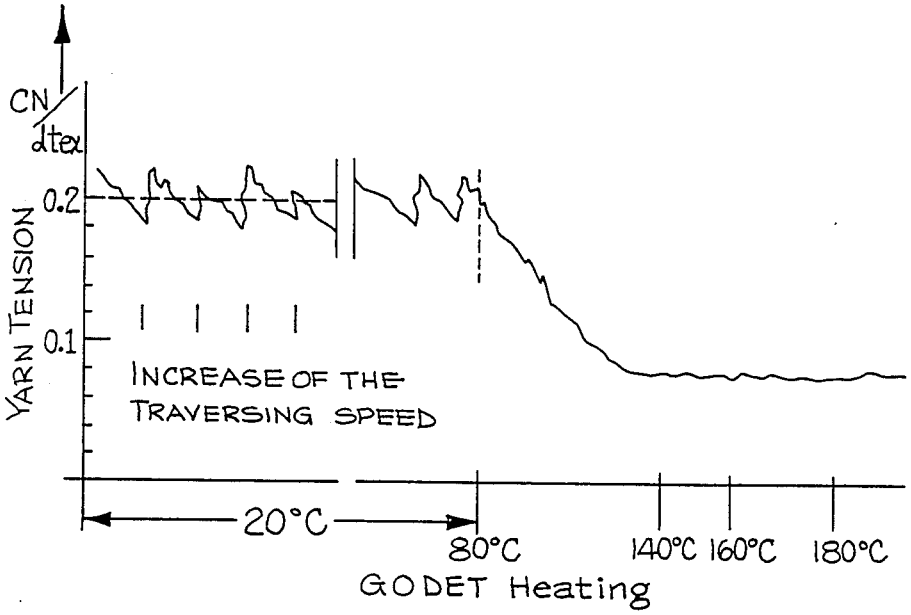

Some of the objects and advantages of the present invention having been stated, others will appear as the description proceeds when taken in conjunction with the following drawings, in which FIG. 1 is a schematic elevation view of a melt spinning and winding apparatus which embodies the features of the present invention; and FIG. 2 is a schematic view of a yarn tension graph.

Referring more particularly to FIG. 1, the apparatus includes a melt spinning apparatus 1 which includes a spinning nozzle plate 2 for extruding a plurality of thermoplastic filaments 3. The filaments may for example comprise a polyethylene terephthalate melt, and the filaments are cooled in a cooling passage 4, and then combined to form an advancing yarn. The advancing yarn receives a fluid from a finish application system 5, and is then guided through an air jet entanglement nozzle 6, which serves to entangle the filaments of the yarn. The yarn is then withdrawn by a feed roll 11. As a specific example, a partially oriented 90f 30 yarn may be withdrawn at a constant speed of 3300 m/minute, utilizing the described apparatus.

The apparatus further comprises a nozzle 17 for applying a finishing fluid which precedes a yarn guide 15. A yarn traversing system is indicated at 12, and a winding spindle 13 is mounted for rotation about an axis generally perpendicular to the yarn advance direction, with the spindle being adapted to receive a bobbin and be rotated by a suitable drive (not shown) so that the bobbin has a constant surface speed and the rotational speed of the package gradually decreases as the package builds, and so as to form a precision cross wound package 14 thereon. An apparatus of this general type is described in the above mentioned Japanese publication.

From the graph of the yarn tension shown in FIG. 2, it is seen that in the case of the 90f30 yarn, when the traversing speed was changed 5%, the changes in the relative yarn tension involved more than 0.025 cN/dtex, when the temperature of the feed roll 11 was 20° C., i.e., was unheated. The relative yarn tension after the yarn guide 15 was 0.2 cN/dtex in its mean value. Upon heating of the feed roll to more than 80° C., the yarn tension was lowered in its mean value to 0.08 cN/dtex, and it was further possible to reduce variations and rapid changes in the yarn tension to a technologically insignificant and hardly measureable amount. The graph of the yarn tension shows that a significant improvement occurred in a relatively narrow temperature range between 80° C. and 140° C. When the temperature was further increased, the further reduction of the relative yarn tension and change in the yarn tension were small, and no longer technologically significant for textile purposes. It is believed that the above temperature range corresponds to the so-called plasticizing range, in which the intermolecular forces in the amorphous portion of the yarn are in part overcome by the heat.

With the present invention, it is possible to operate the winding cycle with a uniform winding ratio until it is insured that the increase of the traversing speed will not result in a winding ratio at which there is a risk of undesirable patterns. Packages having a diameter of more than 500 mm may thus be produced, which have a uniform, ideal build throughout, and which normally have a high risk of pattern formation. Further, the packages do not bulge at their end faces due to the yarn tension, nor do they have any thickened portions on their circumference in the areas of the stroke reversal.

The method and apparatus of the present invention also permits the production of non-oriented, partially oriented, or fully oriented drawn filament yarn in one operation, and at high speed, and the invention is adapted to produce large package size.

While the preferred embodiment has been described as including a heated feed roll preceding the winding system, other possibilities for heating the advancing yarn are available. Specifically, the heating system must be provided at a point in the path of travel of the advancing yarn into which the yarn tension prevalent in the traversing triangle propagates. As a result, the heating may occur downstream of the feed roll 11. Also, heating may be accomplished by water or water vapor, in that the yarn may thereby be plasticized, i.e., the modulus of elasticity lowered.

In the drawings and specification there has been set forth a preferred embodiment of the invention, and although specific terms are employed, they are used in a generic and descriptive sense only and not for purposes of limitation.

That which is claimed is:

1. A method of melt spinning thermoplastic filament yarn and comprising the steps of extruding a plurality of thermoplastic filaments through a spinneret, withdrawing the filaments from the spinneret and combining the withdrawn fialments form an advancing yarn which advances at a constant speed, winding the advancing yarn about a rotating bobbin to form a wound package, and including traversing the yarn laterally back and forth across the face of the package while maintaining the rotational surface speed of the package substantially constant and such that the rotational speed of the bobbin gradually decreases during the build of the package, and while varying the traversing speed of the yarn during each of a series of sequential steps of the winding operation by decreasing in each of the steps the traversing speed of the yarn from an initial value and proportionally to the decreasing rotational speed of the package for a substantially uniform winding ratio and then rapidly increasing the traversing speed to about the initial value, and heating the advancing yarn so as to lower its modulus of elasticity and so that the yarn tension and the yarn denier remain within a predetermined range of variation during each of the winding steps, and such that the yarn tension does not vary by more than about + or −0.04 CN/dtex from a mean value, thereby avoiding undesirable tension fluctuations during the rapid increases of the traversing speed.

2. The method as defined in claim 1 comprising the further step of contacting the advancing yarn with a feed roll, and wherein the heating step includes heating the feed roll to at least about 80° C.

3. The method as defined in claim 1 wherein the step of heating the advancing yarn includes applying sufficient heat such that the yarn tension resulting from each increase in the traversing speed does not increase more than about 0.02 cN/dtex.

4. The method as defined in claim 1 wherein the tension of the yarn immediately prior to being wound onto the package does not exceed about 0.8 cN/dtex, even during the increase in the traversing speed.

5. The method as defined in claim 1 wherein the step of heating the advancing yarn occurs only shortly prior to selected ones of the periodic changes of the traversing speed.

6. The method as defined in claim 1 wherein the step of heating the advancing yarn occurs only shortly prior to those changes of the traversing speed wherein the higher traverse speed is more than about 4% greater than the lower traverse speed.

7. The method as defined in claim 1 comprising the further steps of applying a fluid finish to the advancing yarn, and applying a jet of air to the advancing yarn to entangle the filaments.

8. A method of winding an advancing thermoplastic textile yarn into a bobbin supported package to produce a stepped precision wind, and including the steps of winding the advancing yarn about a rotating bobbin to form a wound package, and including traversing the yarn laterally back and forth across the face of the package, while maintaining the rotational surface speeed of the package substantially constant and such that the rotational speed of the bobbin gradually decreases during the build of the package, and while varying the traversing speed of the yarn during each of a series of sequential steps of the winding operation by decreasing in each of the steps of the traversing speed of the yarn from an initial value and proportionally to the decreasing rotational speed of the package for a substantially uniform winding ratio and then rapidly increasing the traversing speed to about the initial value, and heating the advancing yarn so as to lower its modulus of elasticity and so that the yarn tension and the yarn denier remain within predetermined ranges of variation during each of the winding steps, and such that the yarn tension does not vary by more than about + or −0.04 CN/dtex froma mean value, thereby avoiding undesirable tension fluctuations during the rapid increases of the traversing speed.

* * * * *